United States Patent [19]

Pescarmona

[11] Patent Number: 4,486,141

[45] Date of Patent: Dec. 4, 1984

[54] LINKAGE SYSTEM FOR A LOADER VEHICLE

[75] Inventor: Roberto D. Pescarmona, Turin, Italy

[73] Assignee: Fiat-Allis Europe S.p.A., Lecce, Italy

[21] Appl. No.: 383,592

[22] Filed: Jun. 1, 1982

[30] Foreign Application Priority Data

Jun. 9, 1981 [IT] Italy ..... 67793 A/81

[51] Int. Cl.[3] ..... E02F 3/70

[52] U.S. Cl. ..... 414/697; 414/917

[58] Field of Search ..... 414/685, 697, 706, 707, 414/710–714, 917; 172/484

[56] References Cited

U.S. PATENT DOCUMENTS

| | | | |
|---|---|---|---|
| 2,807,379 | 9/1957 | Pilch | 414/713 X |
| 2,817,448 | 12/1957 | Pilch | 414/713 |
| 2,835,396 | 5/1958 | Pilch | 414/713 X |
| 3,743,126 | 7/1973 | Seaberg | 414/697 X |

*Primary Examiner*—Robert J. Spar
*Assistant Examiner*—Donald W. Underwood
*Attorney, Agent, or Firm*—Robert A. Brown

[57] ABSTRACT

A linkage system for a loader vehicle of the type comprising a pair of parallel lift arms having a first upper end pivotally connected to upper end portions of a vertical bracket member secured to the frame of the vehicle and a second lower end pivoted to an associated lower back portion of a bucket, a pair of bellcrank levers, the central portions of which are pivotally connected to corresponding upper end portions of the lift arms, a pair of connecting links having one or a first end pivotally connected to a lower end of the bellcrank levers and its other end pivotally connected to associated intermediate portions of the bracket members secured to the frame and a pair of bucket cylinders for control of rotation of the bucket about its lower end portion, having a head end pivotally connected to a corresponding upper end of the bellcrank levers and a rod end pivotally connected to an associated upper back end portion of the bucket.

The principal characteristic of the invention comprises a pair of lifting cylinders having a head end pivotally connected to associated lower portions of the bracket members secured to the frame and a rod end pivotally connected to the lower end of the bellcrank levers and alternately to the first end of the connecting links.

3 Claims, 3 Drawing Figures

LINKAGE SYSTEM FOR A LOADER VEHICLE

BACKGROUND OF THE INVENTION

This invention relates, in general, to vehicle linkage systems and, in particular, to a linkage system for use on a vehicle such as earth moving or construction machinery wherein the linkage system is utilized for operating and controlling a loader bucket. More specifically, but without restriction to the particular use which is shown and described, this invention relates to a loader bucket linkage system that is operable to accomplish the function of filling the bucket with material, raising the bucket to a carry position, moving the vehicle to a described located and dumping the material from the bucket at the desired location.

In the operation of contruction machinery vehicles, as is known, linkage systems currently mounted on loader vehicles may include a pair of lift arms pivoted at their ends to the frame of the vheicle and to a lower portion of the bucket, a pair of struts or levers having their intermediate portions pivotally connected to an upper portion of the associated lift arms, a pair of bucket control cylinders having first ends pivotally connected to upper portions of the bucket and second ends pivotally connected to upper ends of associated struts or bucket links, a pair of levers pivotally connected to the frame and to lower ends of associated struts, and a pair of lifting cylinders pivotally connected to the frame and to an intermediate portion of associated arms. There are also used moreover linkage systems which differ from the above in that the intermediate portion of the struts is pivoted to an intermediate portion of the associated arms beneath the pivotal connection of the lifting cylinders. Because of this the struts and the levers are mounted in the space lying between the two arms.

The linkage systems described above have several disadvantages.

In particular, as far as the linkage system first described is concerned, because the lifting cylinders are pivotally connected to the associated arms at a lower portion than the struts, or a lower level thereof, it is necessary to use lifting cylinders of large longitudinal dimensions and therefore of high cost. Moreover, with such an arrangement of lifting cylinders there are greater possibilities for interference with other parts of the machine. If it is desired to reduce the longitudinal dimension of the lifting cylinders and therefore their cost, it is necessary to pivot these latter on a higher lever or an upper portion of the associated arms. But, in order to do this, it is necessary also to shorten the length of the struts and to pivot their intermediate portions on a portion or position of the associated arms nearer to the driver's position with a consequent reduction in the driver's visibility.

Now considering the linkage systems first described, which differ from the preceding ones by the different arrangement of the pivotal connections of the struts and the lifting cylinders on associated lift arms, it is to be noted that with this arrangement the shortening of the lifting cylinders is allowed, but in order to do this it is necessary to place the struts and the levers within the space between the lift arms. This arrangement increases the torsional stresses to which the various constituent parts of the mechanism are subjected and moreover involves an increase in the width of the linkage system or what might be termed the transverse bulk of the linkage system itself.

SUMMARY OF THE INVENTION

Accordingly, it is an object of the present invention to provide a linkage system for a loader vehicle which does not have the cited disadvantages and which thus utilizes a pair of lifting cylinders of reduced longitudinal dimensions and therefore of reduced cost, at the same time increasing the driver's visibility and also reducing the torsional stresses to which the various constituent parts of the linkage system itself are subjected.

According to the present invention there is provided a linkage system for a loader vehicle of the type comprising a pair of parallel lift arms each having a first end pivotally connected to an upper portion of a corresponding substantially vertical bracket member secured to the frame of the vehicle and a second end pivotally connected to an associated lower end of a bucket, a pair of first struts or bellcrank levers, the central portions of which are pivotally connected to corresponding upper end portions of said arms, a pair of first links having first ends pivotally connected to lower ends of the first struts and second ends pivoted to associated intermediate portions of the bracket members of the frame, and a pair of bucket cylinders for operation and control of the rotation of the bucket about its lower end portion, each having a first or head end pivoted to a corresponding upper end of a bellcrank lever and a second or rod end connected through associated linkage to an upper portion of the bucket; characterized by a pair of lifting cylinders each having a first or head end pivoted to a lower portion of the bracket member of the frame and a second or rod end connected, by means of a connecting link including at least one pivot point to the lower end of the bellcrank lever and to the first end of the first lever.

DESCRIPTION OF THE DRAWINGS

Further objects of the invention, together with additional features contributing thereto and advantages accruing therefrom, will be apparent from the following description of several preferred embodiments of the invention that are shown in the accompanying drawings that illustrate a linkage system for loader vehicle.

DESCRIPTION OF THE PREFERRED EMBODIMENT

Figure 1:
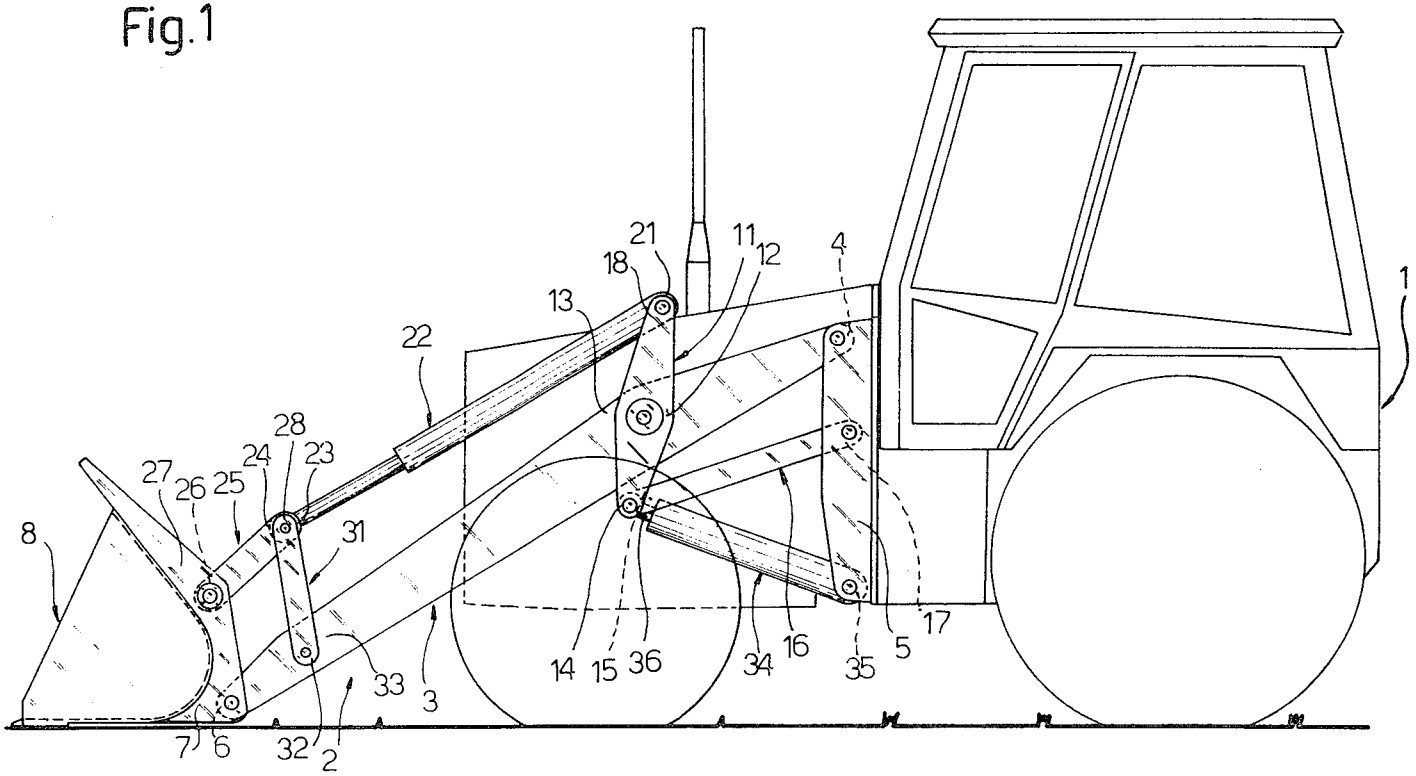
FIG. 1 is a side view of a linkage system mounted on a loader vehicle.

As illustrated in FIG. 1, there is generally indicated a loader vehicle 1 on which there is mounted a linkage system 2 formed according to the principles of the present invention. The system 2 comprises a pair of parallel lift arms 3 disposed to the sides of the front part of the vehicle 1. An upper end 4 of the arms 3 is pivotally connected to an upper end portion of a substantially vertical bracket member or associated plate 5 secured to and projecting from the frame of the vehicle 1, while a lower end 6 is pivotally connected to an associated lower back end portion 7 of a bucket 8. The system 2 includes a pair of struts or bellcrank levers 11, the central portions 12 of which are pivotally connected to associated upper end portions 13 of the corresponding lift arms 3 and disposed outside of or on the outer surfaces thereof. A lower end 14 of the levers 11 is pivotally connected to a first end 15 of associated connecting links 16. The links 16 have a second end 17 pivotally connected to an intermediate portion of the bracket member 5. An upper end 18 of each lever 11 is pivoted to a first or head end 21 of an associated bucket control cylinder 22 for operation and control of the rotation of the bucket 8 about the connection points between itself and the arms 3. A second or rod end 23 of each bucket cylinder 22 is pivotally connected to a first end 24 of an associated link 25, a second end 26 of which is pivoted to an associated upper back end portion 27 of the bucket 8. To the rod end 23 of each cylinder 22 there is pivotally connected an upper end 28 of an associated link 31, a lower end 32 of which is pivotally connected to a lower end portion 33 of the associated lift arm 3. The system 2 additionally includes two lifting cylinders 34, a first or head end 35 of which is pivotally connected to a lower portion of the bracket member 5 and a second or rod end 36 of which is pivotally connected to the lower end 14 of the associated lever 11.

Figure 2:
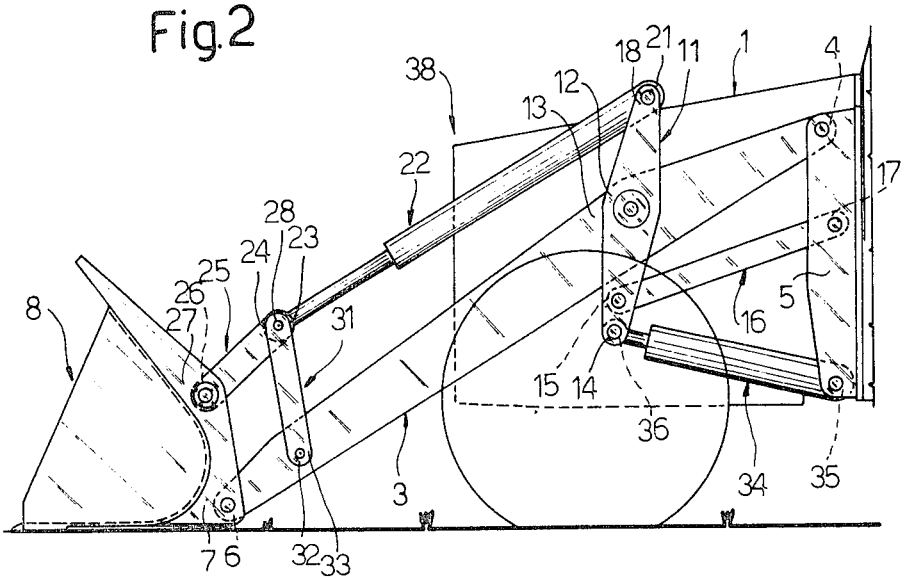
FIGS. 2 and 3 are side views of two alternate linkage systems of different configuration from that illustrated in FIG. 1.

As illustrated in FIG. 2, there is shown a linkage system generally indicated by the reference numeral 38 that differs from the system illustrated in FIG. 1 only in that the ends 15 of the links 16 are pivotally connected to associated levers 11 at a portion intermediate between the central portion 12 and the lower end 14.

Figure 3:
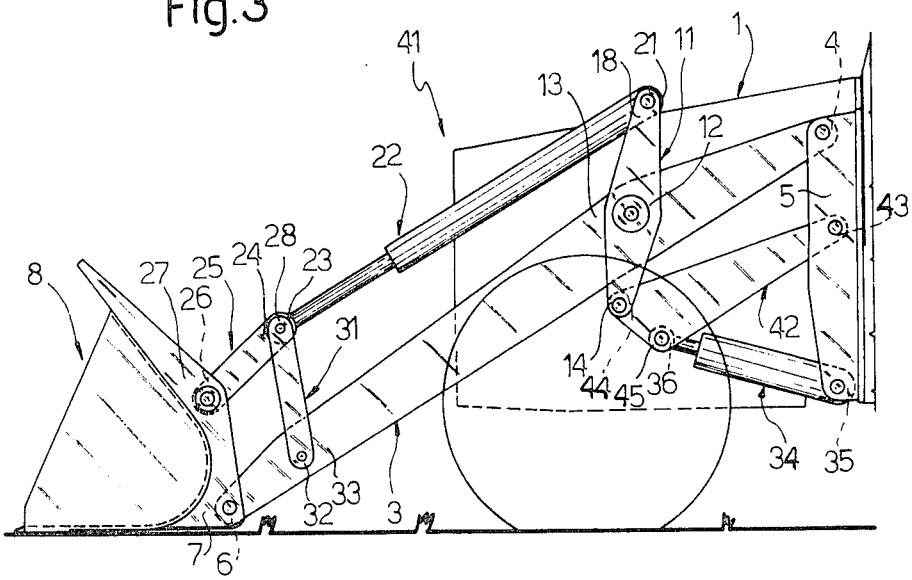

With reference to FIG. 3, there is shown a linkage system generally indicated by the reference numeral 41 that differs from the system 2 by the different configuration of the links 16. As illustrated, the system 41 includes two substantially triangular levers 42, a first vertex 43 of which is pivotally connected to the central portion of the bracket member 5, a second vertex 44 of which is pivotally connected to the lower end 14 of the associated bellcrank lever 11, and a third vertex 45 of which is pivotally connected to the end 36 of the associated lifting cylinder 34.

The various parts constituting the systems 38 and 41 and which are similar to those of system 2 are indicated in FIGS. 2 and 3 with the same reference numerals used for the corresponding parts of the system 2.

The advantages obtained by the embodiments of the present invention are numerous.

In particular, lifting cylinders 34 of reduced longitudinal dimensions are used with consequent reduced cost while maintaining the pivotal connection of the levers 11 to the associated lift arms 3 at a location 13 spaced from the operator's position and therefore not obstructing or detracting from the visibility available to the operator. Moreover, with the described arrangement of the lifting cylinders 34, the possibilities of interference with the other parts of the vehicle 1 are reduced. And, the lever 11 being pivotally connected and disposed outside of or on the outer surfaces of the arms 3, there is a reduction in the torsional stresses to which the various parts of the system in question are subjected, and the transverse bulk of the system itself is reduced. With systems obtained according to the principles of the present invention the number of pivotal points are also reduced and therefore because of lower cost and a shorter assembly time there is obtained a more efficient and solid structure.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A linkage system for a loader vehicle comprising a pair of lift arms each having a first end pivotally connected to an upper portion of a bracket member secured to the frame of the vehicle and a second end pivotally connected to a lower portion of a bucket, a pair of levers pivotally connected substantially intermediate their ends to said lift arms at corresponding locations on the lift arms near the pivotal connection between the first ends of the lift arms and the upper portions of the bracket members, said levers each having an upper end portion and a lower end portion extending generally upwardly and downwardly from its pivotal connection with a respective lift arm, a pair of first links each having a first end pivotally connected to a corresponding lever lower end portion and having a second end pivotally connected to a corresponding bracket member substantially intermediate its ends, a pair of control cylinders for controlling rotation of the bucket about its lower portion, each having a first end pivotally connected to a corresponding lever upper end portion and a second end pivotally connected to an upper portion of the bucket, a pair of lifting cylinders of relatively reduced length, each having a first end pivotally connected to a corresponding bracket member lower end portion and having a second end pivotally connected to a corresponding first link, and said first links each having a substantially triangular configuration such that its first end has a first and second vertex respectively pivotally connected to said lower end of one of the levers and to said second end of one of said lifting cylinders.

2. A linkage system according to claim 1, characterized by said second end of each of said lifting cylinders being pivotally connected to said second vertex of an associated one of the links by means of a first pivot pin, and each said first vertex of the associated first links being pivotally connected to said lower end of the associated one of the levers by means of a second pivot pin, said second pivot pin being disposed at a position spaced from and higher than said first pivot pin.

3. A linkage system according to claim 1, characterized by a pair of second links, a first end of which being pivotally connected to said second end of said control cylinders, and a second end being pivotally connected to said upper portion of said bucket, and a pair of third links, an upper end of which being pivotally connected to each said second end of said control cylinders and a lower end being pivotally connected to an associated lower portion of said lift arms.

* * * * *